US009267681B2

(12) United States Patent
Barudi et al.

(10) Patent No.: US 9,267,681 B2
(45) Date of Patent: Feb. 23, 2016

(54) AUTOMATIC FUELING OF LIQUID FUEL BURNERS

(75) Inventors: Samir Barudi, Huntington Beach, CA (US); David Merrill, Mount Vernon, IA (US); Chris Caron, Stockton, CA (US)

(73) Assignee: DURAFLAME, INC., Stockton, CA (US)

( * ) Notice: Subject to any disclaimer, the term of this patent is extended or adjusted under 35 U.S.C. 154(b) by 222 days.

(21) Appl. No.: 13/426,516

(22) Filed: Mar. 21, 2012

(65) Prior Publication Data

US 2013/0071795 A1 Mar. 21, 2013

Related U.S. Application Data

(63) Continuation-in-part of application No. 13/102,857, filed on May 6, 2011.

(51) Int. Cl.
*F23D 5/14* (2006.01)
*F23D 5/04* (2006.01)
(Continued)

(52) U.S. Cl.
CPC .. *F23D 5/14* (2013.01); *F23D 5/04* (2013.01); *F23K 5/06* (2013.01); *F23K 5/14* (2013.01); *F23K 5/147* (2013.01); *F24B 1/199* (2013.01); *F23K 2301/20* (2013.01)

(58) Field of Classification Search
CPC ..... F23D 5/14; F23D 5/04; F23D 2202/00; F23D 2206/0057; F24B 1/199; F23K 5/06; F23K 5/14; F23K 5/147; F23K 2301/20
USPC ..... 431/7, 328, 333, 125, 150, 152, 331; 126/500, 512
See application file for complete search history.

(56) References Cited

U.S. PATENT DOCUMENTS 2,495,230 A 1/1950 Day
3,817,686 A 6/1974 Quittner
(Continued)

FOREIGN PATENT DOCUMENTS

DE 102009043341 9/2010
EP 0096111 12/1983
JP 2003-343837 12/2003

OTHER PUBLICATIONS

International Search Report and Written Opinion of International Application No. PCT/US2012/036642 mailed Nov. 29, 2013.
(Continued)

*Primary Examiner* — Alfred Basichas
(74) *Attorney, Agent, or Firm* — Koppel, Patrick, Heybl & Philpott

(57) ABSTRACT

A fire display assembly has a burner tray optionally located within a hollow space in the interior of a non-flammable structure. A porous element on or in the non-flammable structure has extensions from a lower surface thereof extending into fuel in the burner tray. The assembly can include a fuel tray connected to the burner tray by conduits which provide flow channels for liquid fuel between the trays. When a container of liquid fuel is placed in the fuel tray the fuel is dispensed and flows into the burner tray. Fuel in the tray is transmitted to the outer surface of the porous element. Flammable vapors from the liquid fuel at the outer surface are then ignited. The arrangement provides a continuous feed of fuel to the surface of the non-flammable structure and allows safe replenishment of the fuel in the burner while the flame is present.

12 Claims, 17 Drawing Sheets

(51) Int. Cl.

| | |
|---|---|
| ***F23K 5/14*** | (2006.01) |
| ***F23K 5/06*** | (2006.01) |
| ***F24B 1/199*** | (2006.01) |

(56) References Cited

U.S. PATENT DOCUMENTS

| | | | | |
|---|---|---|---|---|
| 3,993,430 | A | 11/1976 | Forker | |
| 4,582,478 | A | 4/1986 | Hilker | |
| 4,838,781 | A | 6/1989 | Fischer | |
| 5,662,468 | A | 9/1997 | Henderson | |
| 5,858,031 | A | 1/1999 | Perlman | |
| 6,010,332 | A * | 1/2000 | Lee et al. | 431/320 |
| 6,267,113 | B1 | 7/2001 | Maust et al. | |
| 7,458,808 | B2 | 12/2008 | McCarren | |
| 2005/0178379 | A1 | 8/2005 | Weinberger | |
| 2006/0037604 | A1 | 2/2006 | Hoffmann et al. | |
| 2009/0214997 | A1 * | 8/2009 | Stellema | 431/323 |
| 2009/0241936 | A1 * | 10/2009 | Husted et al. | 126/512 |
| 2011/0048402 | A1 | 3/2011 | Houle | |

OTHER PUBLICATIONS

"Bioethanol fireplaces", ArchiExpo 2011, p. 1-4 (Mar. 23, 2011) <http://www.archiexpo.com/architecture-design-manufacturer/bioethanol-fireplace-3078 .html>.

"Bioethanol fireplaces", ArchiExpo 2011, p. 1-3 (Mar. 23, 2011) <http://www.archiexpo.com/architecture-design-manufacturer/bioethanol-fireplace-3078-__.html>.

"FMI Products, LLC", p. 1-2, <www.fmiproducts.com >.

"Sterno", Wikipedia, p. 1-2 (Mar. 23, 2011) <http://en.wikipedia.org/wiki/Sterno>.

Extended Search Report of European Patent Application No. 12782912.5 issued Sep. 19, 2014.

* cited by examiner

AUTOMATIC FUELING OF LIQUID FUEL BURNERS

This is a continuation-in-part application claiming benefit of U.S. patent application Ser. No. 13/102,857, filed May 6, 2011.

BACKGROUND

The invention relates to liquid fuel indoor and outdoor fire displays, particularly burner assemblies configured to burn a liquid fuel, such as an alcohol, paraffinic oils, plant oils, and flammable petroleum or other flammable natural products, either in a liquid or gel form.

Historically, alcohol burning hearth products (fireplaces, stoves, log sets, vessels for containing open flames) and other flame displays such as garden torches, tiki torches, etc. comprise a burner that is filled with alcohol or other liquid fuel, usually a denatured ethanol, or in the alternative, cans of flammable solidified gelled alcohol, or liquid gelled alcohol, that are then lit to create the flame. Depending on the configuration of the burner and the size of the fuel reservoir, once ignited the fuel will burn until consumed, generally for 1-4 hours. Some burner configurations include a damper that will allow the flame to be extinguished prior to full consumption by covering the flame and restricting access to air. To extend the burning time the user typically has to wait until the fuel has burned completely, or the flame is extinguished, and the burner has cooled down before adding more flammable liquid or replacement can of gelled fuel into the burner and lighting it again. This procedure presents a number of problems which include:

a) The possibility of spilling a highly volatile and flammable fluid on the fireplace or stove assembly and log set, which presents the possibility of unintended combustion thus creating an unsafe situation;
b) Spilling the fuel on a person's arm, clothing or on the floor which can also create a fire hazard;
c) Because the fuels are highly volatile, and it is the vapors off the fuel and not the liquid fuel itself that is burning, these vapors present a very serious risk of accidental ignition. This hazard requires the user to wait for the flame to extinguish and the burner to cool down before refueling to prevent vaporized fuel from spontaneously igniting during the filling process and a flame possibly propagating back to the container of fluid from which the fuel is being poured, thus creating a very hazardous situation where the fumes in the container are burning and burning fuel is ejected out of a container, thus acting like a flame thrower;
d) Additionally, ethanol, unless specifically blended with additives to provide a visible flame, tends to burn with a nearly invisible color, especially in well-lit areas, causing spills to be very dangerous since it is sometimes impossible to notice that the fuel has ignited. Certain burner assemblies are designed to create yellower flames that are more visible, especially after the fuel has been ignited for some time; the conditions that make the flame visible in the burner assembly do not exist to allow visualization of burning fuel spills; and
e) The fuel level inside the burner of an ethanol burning assembly is constantly changing as the fuel is consumed and thus is not always at an optimum level for aesthetics or for clean combustion of the fuel.

These liquid fuel burners in many instances are used as unvented appliances in unvented spaces. As a result, the emissions from combustion end up in the room. Thus clean and complete combustion is very important. An improperly designed or operated liquid fuel burner, or the use of the wrong liquid fuel, can release fuel vapors and carbon monoxide into the room. As a result, consumers have been reluctant to use the currently available ethanol burners.

One product provides for pouring fuel into a reservoir that is then slid into the fireplace assembly from outside the burner assembly. However, this design still requires pouring the fuel from an open bottle, allows for the release of flammable vapors and does not safely allow additional fuel to be added while the fuel is burning.

SUMMARY

A particular advantage of the disclosed design is that it provides an assembly that allows the user to replenish the fuel while the flame is burning without any hazard of a fuel spill or vapor release. Embodiments of the device disclosed herein provide a fuel tray and fuel feed arrangement designed, in conjunction with a nonflammable structure, particularly an artificial log, to keep the burning vapors above the surface of the structure within a preferred range for proper and complete combustion for a substantial portion of the time that a flame is being provided. Alternatively, if more than one such assembly is used, one or more such assemblies may be positioned lower than other assemblies so that fuel in a lower assembly continues to burn while others run out of fuel.

DETAILED DESCRIPTION

Disclosed herein are arrangements for feeding liquid fuel in indoor and outdoor fire displays. The arrangements are particularly suited to the delivery of alcohol based liquid fuels, particularly methanol, ethanol, propanol, butanol, etc. or mixtures of such fuels, but are not so limited. Other liquid fuels can be used such as ester oils, plant oils, paraffinic compositions, and flammable petroleum or bio-sourced flammable products, either in a liquid or gel form. The fire displays may be in a fireplace or stove or free standing such as a fire pit or decorative flame display with or without artificial firelogs. As alternatives, the fire displays may include, in place of the artificial logs various media to enhance the decorative appearance of the fire display, such as glass beads, chunks or shards, stones, metal sculptures, water features, etc and various combinations thereof. The disclosure herein is directed to various arrangements for intermittently continuously feeding the liquid fuel or placing the liquid fuel in the vicinity of a wicking element and is not dependent on the decorative materials surrounding the burner and the burning vapors emanating from the fuel.

Figure 1:
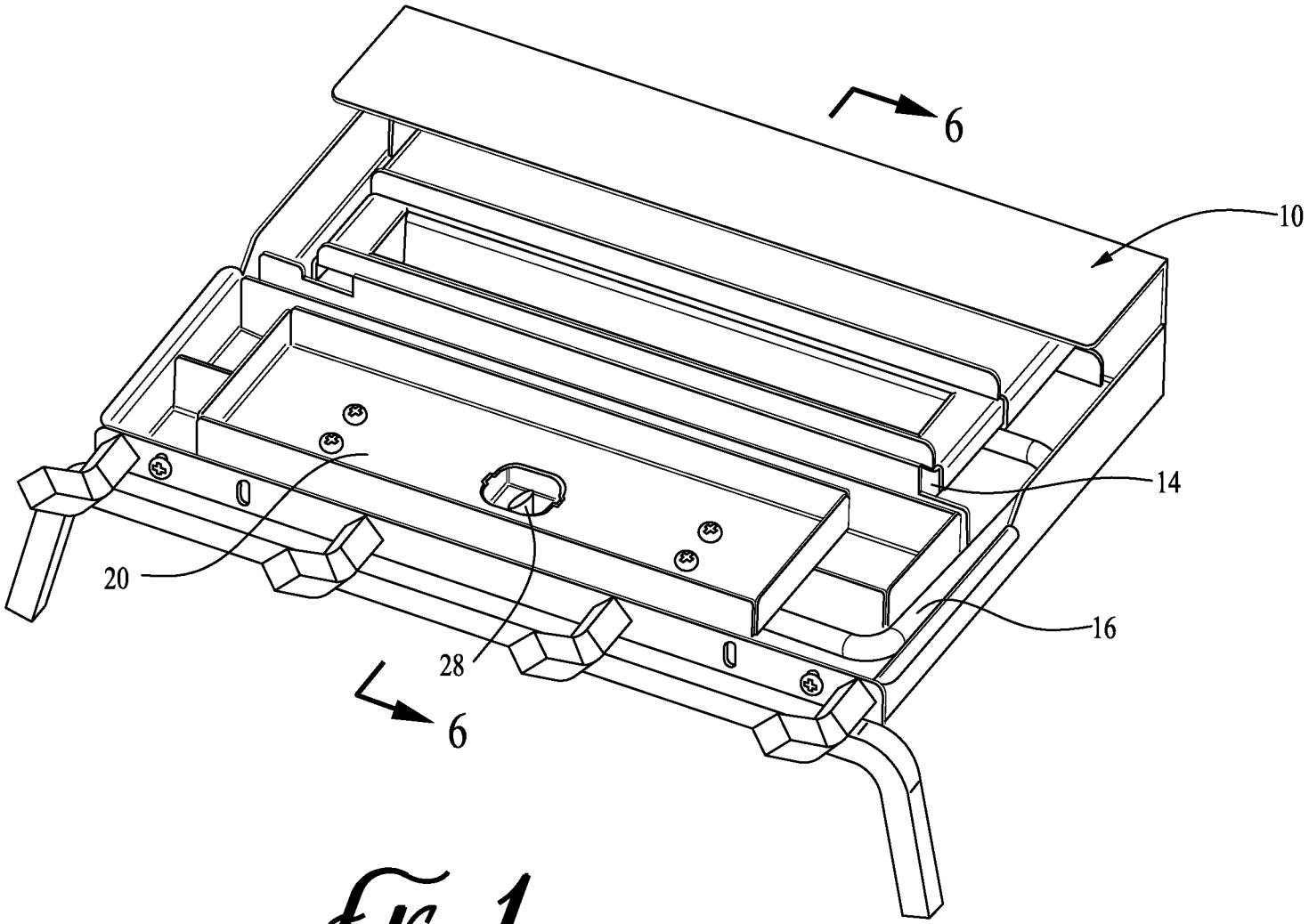
FIG. 1 is a front perspective schematic view of a first embodiment of a liquid fuel burner assembly incorporating features of the invention.
Figure 2:
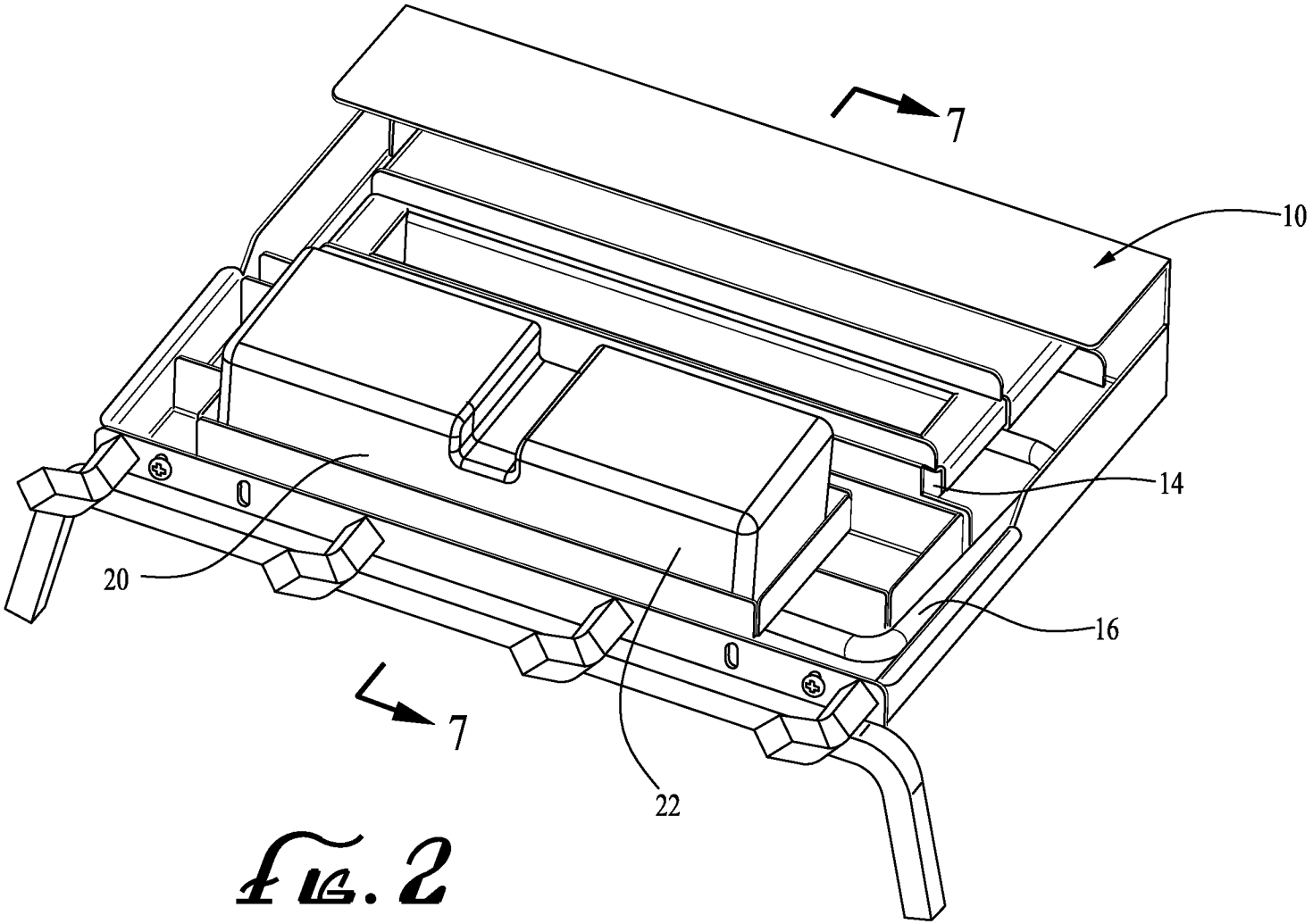
FIG. 2 is a front perspective schematic view of the liquid fuel burner assembly of FIG. 1 including a fuel delivery bottle.
Figure 3:
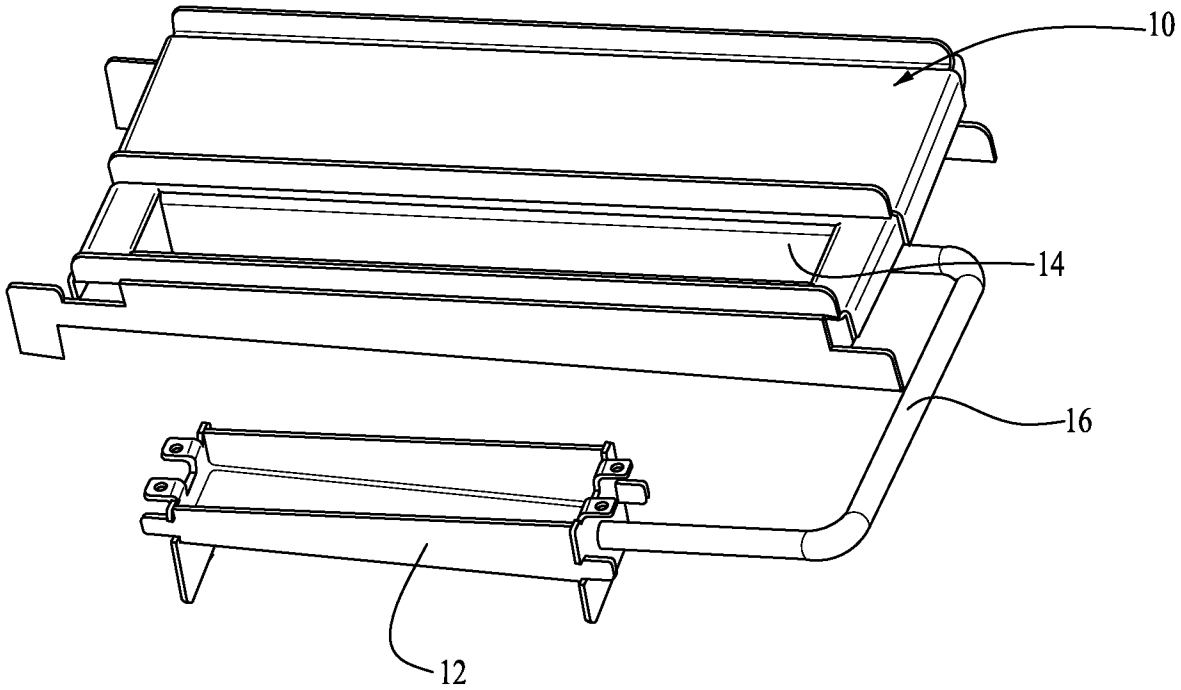
FIG. 3 is a front perspective schematic view of the burner and fuel reservoir portions of FIG. 1.
Figure 13:
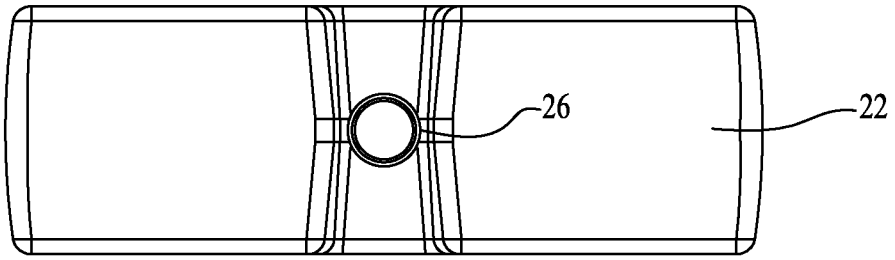
FIG. 13 is a top schematic view of a bottle containing a liquid fuel for placement in the burner assemblies of FIGS. 1-12.
Figure 14:
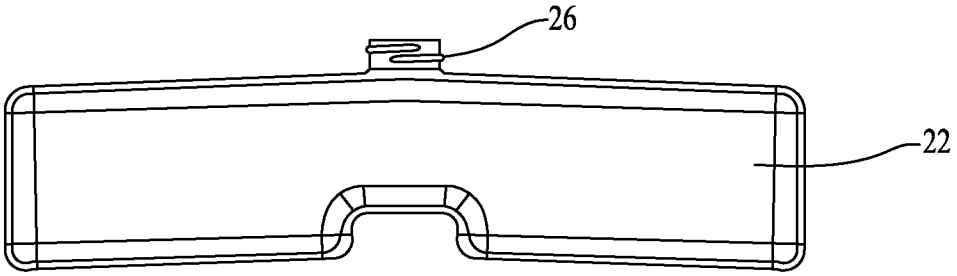
FIG. 14 is a front schematic view of a bottle containing a liquid fuel for placement in the burner assemblies of FIGS. 1-12.
Figure 15:
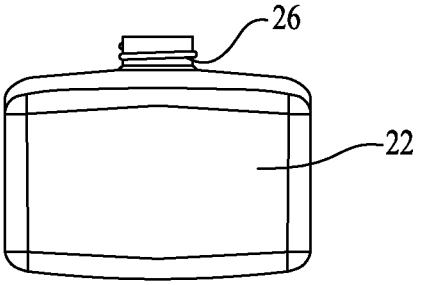
FIG. 15 is end schematic view of a bottle containing a liquid fuel for placement in the burner assemblies of FIGS. 1-12.
Figure 16:
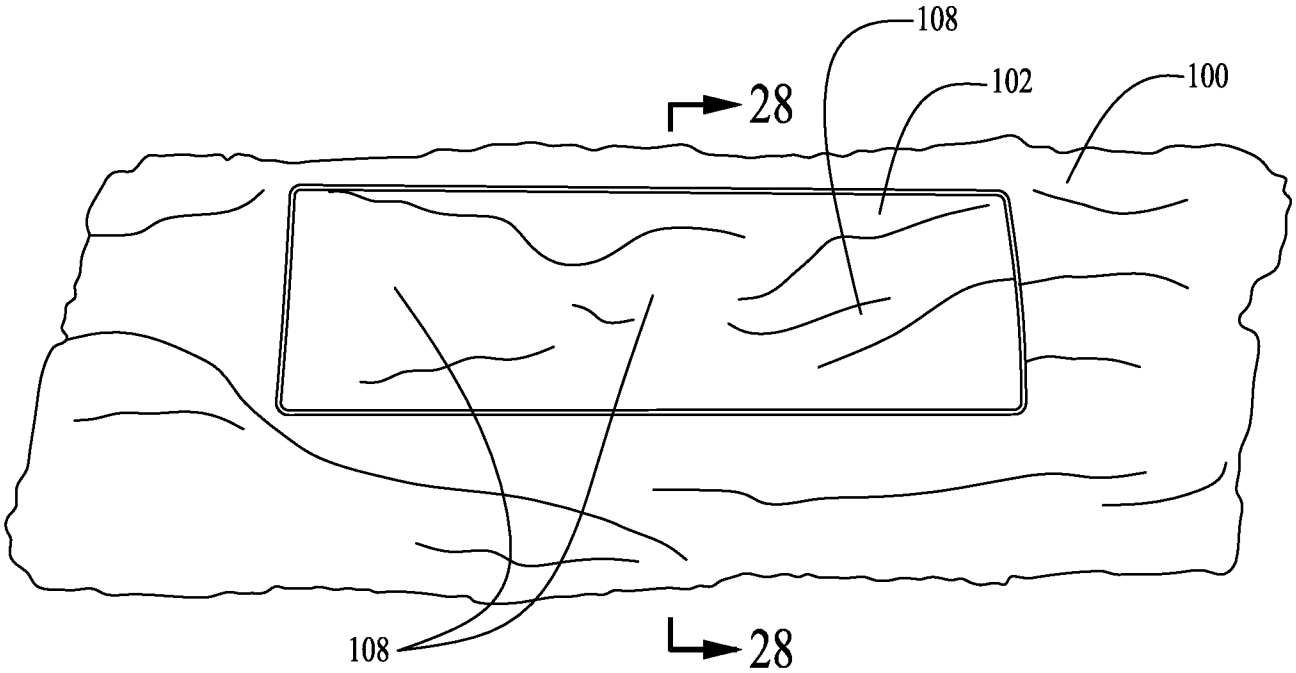
FIG. 16 shows a further embodiment of an artificial log and fuel burner incorporating features of the invention.

Referring to FIGS. 1-4 and as best shown in FIG. 3, a liquid fuel burner assembly 10 includes a fuel receiving reservoir 12, a burner 14 connected to the fuel receiving reservoir 12 by a conduit, preferably a tube 16 or other closed conduit and a bottle receiving tray 20. While a structure referred to as a "tray" is shown, the tray merely identifies a location for placement of the bottle and a physical structure such as a tray is not necessary. A bottle 22 for containing the liquid fuel 24 such as shown in FIGS. 13-15, is designed to be placed on the bottle receiving tray 20 with an access port or pouring spout 26 in the bottle 22 downwardly positioned over the fuel receiving reservoir 12. The term "bottle" is used to indicate any container for the liquid fuel and it is not intended to limit the disclosure to a glass or plastic container. In addition, the bottle spout is sealed with a foil seal that prevents the fuel from exiting the bottle when the spout is pointed downwards prior to breaking that seal. The assembly may include a piercing implement 28 as shown in FIGS. 1, 5, 6, 7, 8 and 9 or other suitable bottle openers so that when a sealed bottle 22 is placed on the tray 20 the pouring spout 26 is opened allowing the liquid fuel to pour out of the bottle 22 and into the fuel receiving reservoir 12. Alternatives include but are not limited to valves, removable plates, or other devices intended to prevent premature delivery of the fluid from the bottle that are combined with a mechanism that would allow the fuel to exit the bottle once the bottle is placed in its proper position in or on the device disclosed.

Figure 4:
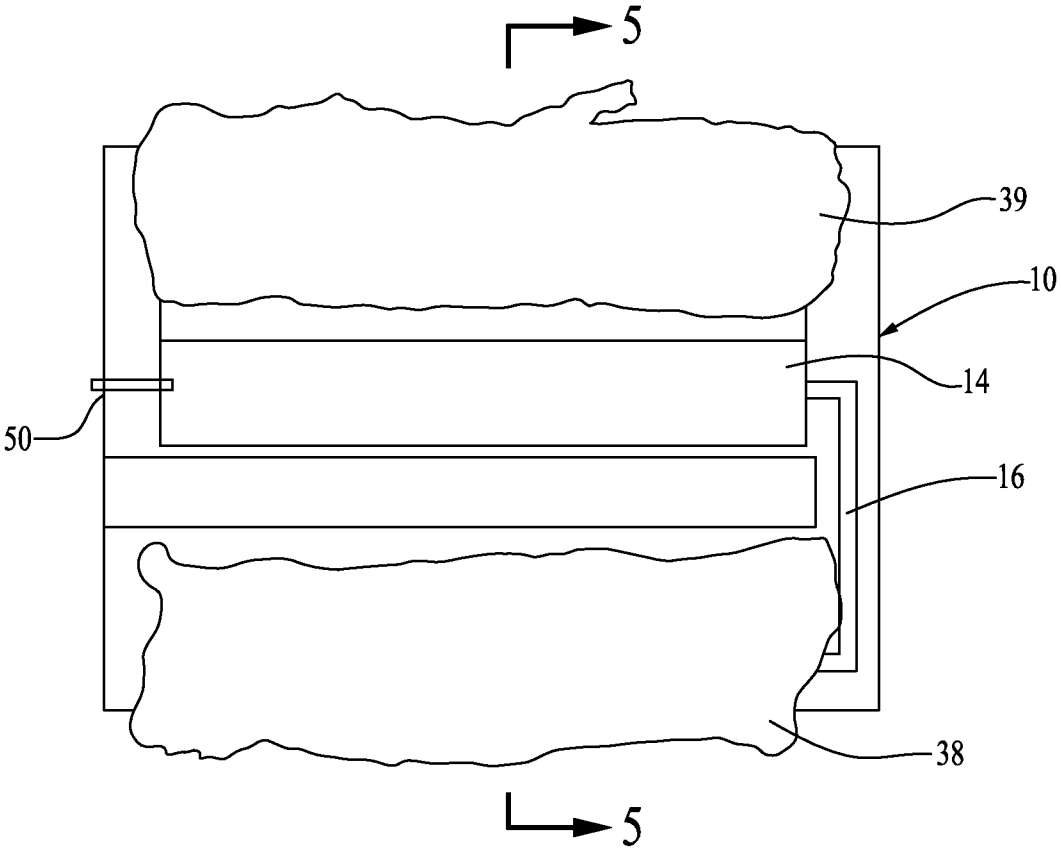
FIG. 4 is a top schematic view of the liquid fuel burner assembly of FIG. 1 with artificial logs placed on top of the burner and fuel reservoir assembly.
Figure 5:
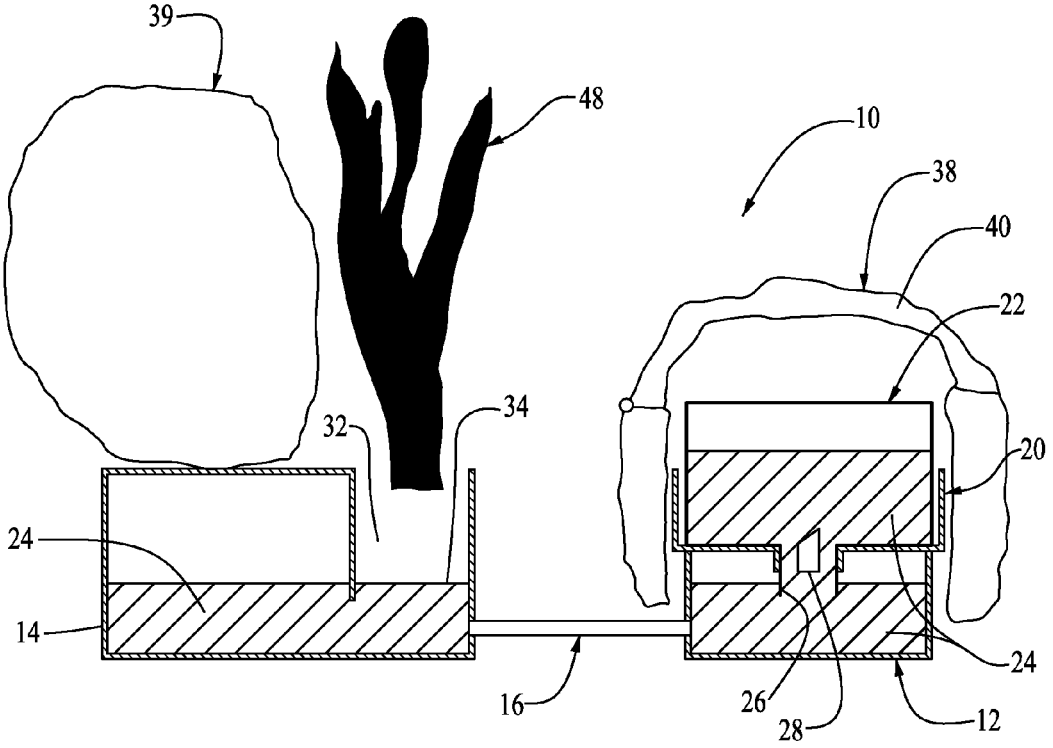
FIG. 5 is a left end schematic sectional view taken along line 5-5 of FIG. 4 showing the liquid fuel burner assembly of FIG. 1 in operation.

FIG. 4 is a top view of the liquid fuel burner assembly 10 of FIGS. 1-3 with artificial logs 38, 39, preferably constructed of a ceramic material or other non-flammable material, formed to resemble real wooden logs. As best shown in FIG. 4, the burner 14, which may comprise one or more compartments, is positioned to provide a burning area between the rear log 38 and the front log 39. When the vapor 32 over the liquid fuel 24 is ignited to produce a flame 48 (as shown in FIG. 5), as described below, the assembly appears to an observer as if it is a natural log fire. The burner can be positioned in any location desired in relation to the logs; as an example, it can comprise only one log behind, in front of it or to the side of the burner, or not have any logs next to or around the burner.

FIG. 5 is a cross sectional view taken along line 5-5 of FIG. 4, providing a schematic representation of the liquid fuel burner assembly 10 in operation. A flame 48 is shown emanating from vapors above the fuel 24 residing in the burner 14 at a location between the front and rear artificial logs 38, 39. One skilled in the art will recognize that while the disclosed embodiment shows two artificial logs, it is contemplated that more than two logs and/or more than two burners 30 can be used to provide a larger appearing fire.

Figure 6:
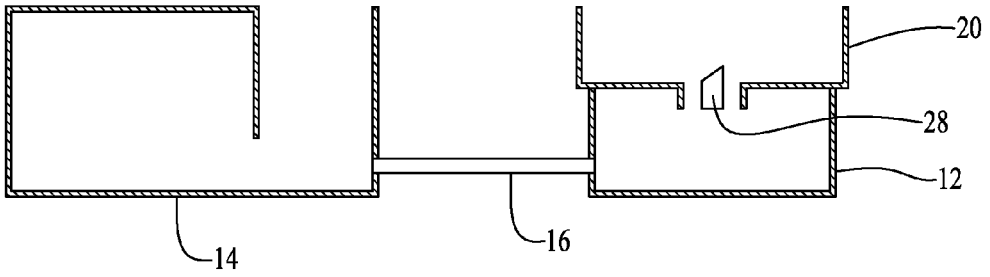
FIG. 6 is a left end schematic sectional view taken along line 6-6 of FIG. 1 showing the liquid fuel burner and fuel reservoir assembly of FIG. 1 prior to installation of a fuel bottle.
Figure 7:
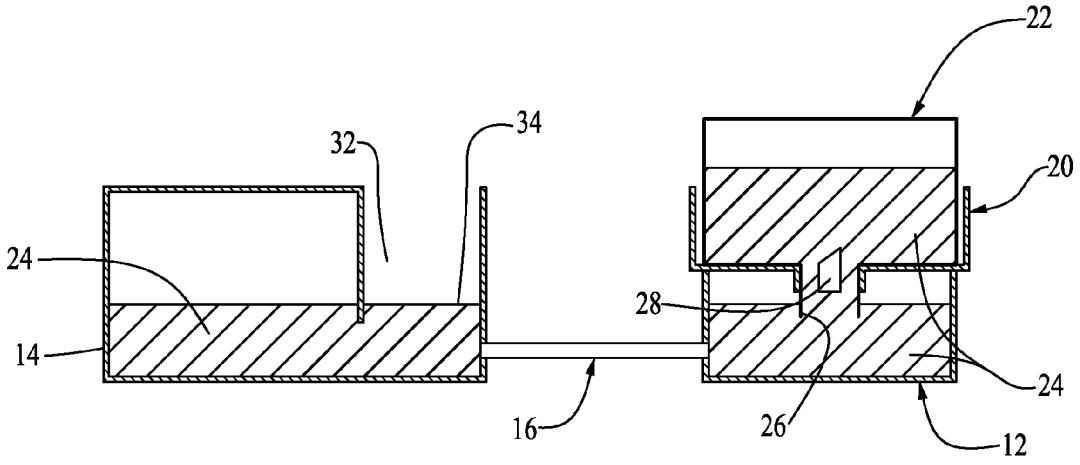
FIG. 7 is a left end schematic sectional view taken along line 6-6 of FIG. 1 showing the liquid fuel burner and fuel reservoir assembly of FIG. 1 after installation of a fuel bottle but prior to ignition.

FIG. 6 shows one particular embodiment of a liquid fuel burner assembly 10 prior to placement of the bottle 22. On placing the filled fuel bottle 22 on the bottle receiving tray 20 the sealed bottle access port 26 is pierced by the piercing element 28. Fuel 24 then flows from the bottle 22 into the fuel receiving reservoir 14 and then through tube 16 and into a burner 14. Flow into the reservoir 12 stops as a result of the creation of a lesser pressure space (a vacuum) that forms in the bottle 22 in the air space over the fuel as the fuel flows out of the bottle and the fuel level in the reservoir 12 is above the lip of the pouring spout/access port 26. This arrangement allows the burner 14 to fill only to a preset level slightly above the bottom edge of the access port 26, which in turn provides a fuel level in the burner 14 approximating the height of the fuel 24 in the fuel receiving reservoir 12 as shown in FIG. 7. This invention also provides the added benefit that the burner cannot be overfilled as can occur with prior art systems. In an instance where the volume of the fluid in the bottle is not enough to allow the top surface of the fluid to cover the lip of the pouring spout, all of the fuel remaining in the bottle will be allowed to exit the bottle and as a result the fuel level never reaches the preset level. In such a case the present invention still provides all the other benefits of this invention even though it does not provide for the liquid level remaining at the optimum preset level.

Figure 8:
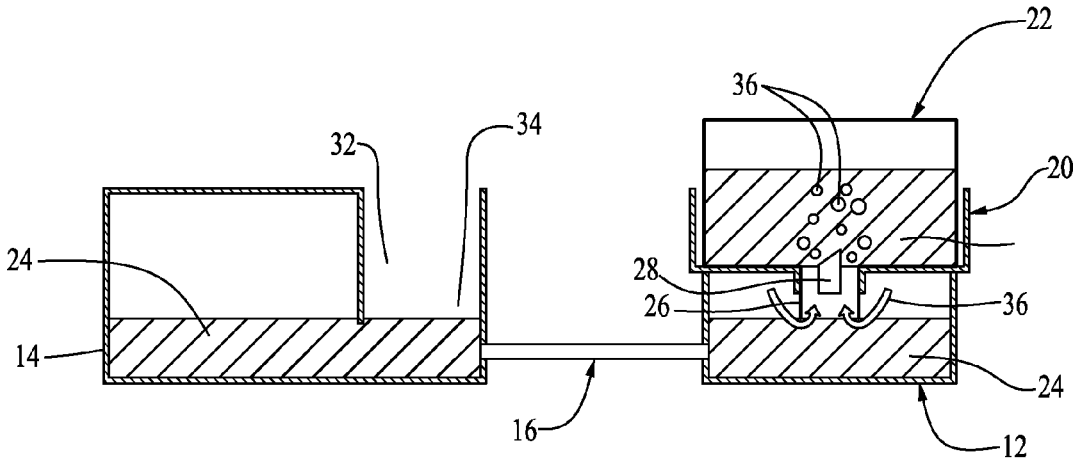
FIG. 8 is a left end schematic sectional view taken along line 6-6 of FIG. 1 showing the liquid fuel and fuel reservoir assembly of FIG. 1 after burning for a period of time.
Figure 9:
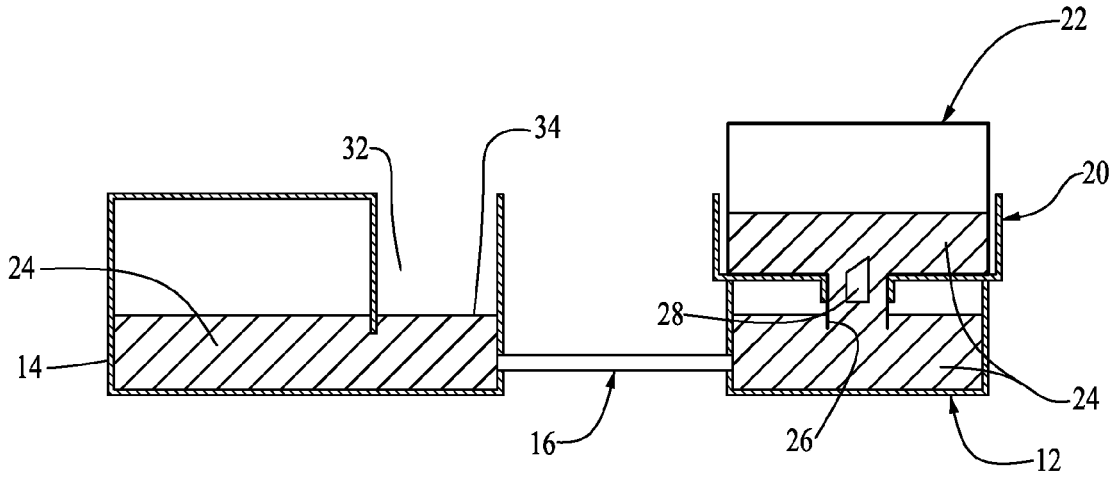
FIG. 9 is a left end schematic sectional view taken along line 6-6 of FIG. 1 showing the liquid fuel burner and fuel reservoir assembly of FIG. 1 after burning for an additional period of time.

Flammable vapor 32 accumulates above the surface of the liquid fuel in the burner 14; once ignited the flame then emanates from the vapor 32 at a distance above the fuel surface 34 as shown in FIG. 5. The vapor can be lit using any flame source, such as a match, propane or butane lighter, spark igniter, heated surface such as an electrically heated coil, etc. FIG. 4 shows an optional access port 50 for insertion of the ignition means into the vaporized fuel. In the alternative, the access port 50 may instead be a built-in igniter such as a spark generator or an electrically heatable coil. As the fuel 24 in the burner is consumed by burning of the vapors, the fuel level in the burner 14 begins to drop. This in turn causes the fuel level in the fuel receiving reservoir 12 to likewise drop slightly, such as shown in FIG. 8, allowing air 36 (as represented by the arrows in FIG. 8) to flow into the bottle 22, thus allowing more fuel 24 to flow from the bottle to replenish the fuel levels in the reservoir 12 and burner 14 until the fuel in the reservoir 12 once more covers the bottle opening (FIG. 9), thus stopping fuel flow. The fuel levels shown in the drawings are exaggerated for clarity; in actual operation the fuel level stays in a narrow range just below to just above the lip of the access port opening. This cycle continues until the bottle 22 is empty, at which point another bottle 22 can be placed into the bottle receiving tray 20, thus refilling the burner 14. Changing bottles does not require waiting until the flame is extinguished. Prior art devices usually required complete consumption of the fuel in the burner, and the liquid fuel burner assembly 10 to have cooled down. As taught herein, a bottle of fuel typically containing 0.5 to 2 liters of fuel can be installed in the burner assembly to support a burn for at least about 1-4 hours. However, larger or smaller containers can be used and the assembly described herein is not limited by the size of the containers. A new bottle can be installed once the previously installed bottle is empty, so that the flame can burn continuously. In an instance where the fuel volume in the bottle is not enough to reach the preset level, the bottle will empty before the unit is ignited and another bottle can then be placed on the unit. This arrangement also prevents the fuel from overfilling the burner and spilling out of the unit (as can occur with other devices currently in the market). The fire is not limited in time to a burn from a single bottle of fuel; it is limited only by the quantity of fuel bottles available. This design also allows the burner to be much smaller than most prior burners as the size of the burner does not depend on the size of the fuel reservoir necessary to hold enough fuel for a sustained burn. Having a smaller burner results in a smaller mass, thus allowing the burner to heat up faster so that the flame reaches its full effect much faster than prior designs. Alternative designs can have a bottle that reseals itself when removed, thus if a bottle is used that has a relatively large volume, the fuel delivery can be stopped by removing the bottle and the resealing feature would prevent any spillage at that point.

Figure 12:
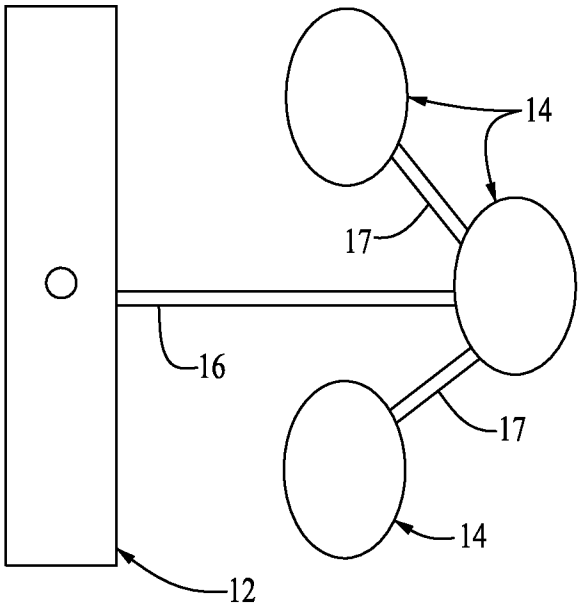
FIGS. 11 and 12 are schematic drawing of second and third embodiments of the liquid fuel burner assembly including multiple burners.
Figure 11:
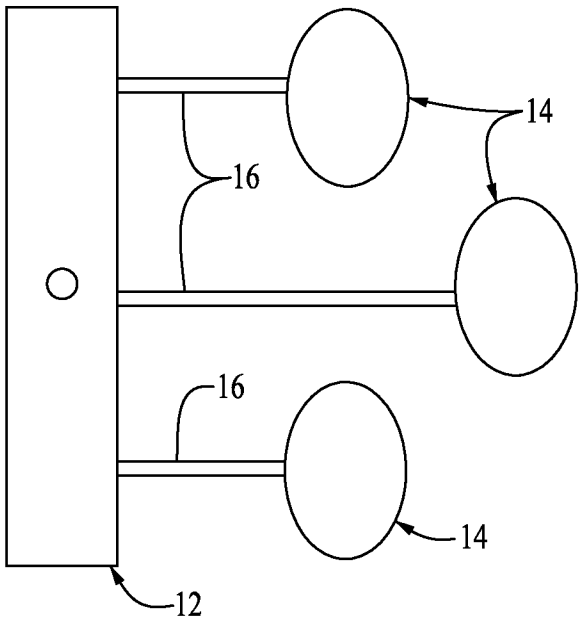

The embodiment of FIGS. 1-9 includes a large burner 14 which is divided into two compartments. However, single compartment burners are also suitable. FIGS. 11 and 12 are schematic drawings of a second and third embodiment including multiple smaller burners 14 connected to a fuel receiving reservoir 12. In FIG. 11 three burners 14 are spaced from the fuel reservoir 12, each burner receiving the liquid fuel through a dedicated tube 16. The arrangement in FIG. 12 has a single tube 16 attached to the reservoir 14 that tube then being connected to the auxiliary tubes 17 for feeding the individual burners. However, the invention set forth herein is not limited to the embodiments shown and one skilled in the art, based on the teachings herein will recognize that numerous variations with multiple burners, feed tubes and fuel reservoirs can be utilized to move the flammable liquid from the storage bottle to the burner and all of these embodiments will allow the use of multiple bottles of liquid fuel, all of which can be readily replaced without interrupting the flame in the one or more burners. While not shown, it is contemplated that multiple fuel bottles and multiple fuel reservoirs can likewise be used to fuel one or more burners. Further, the multiple burners can be positioned so that one or more burners will contain fuel after the fuel in the other burners is depleted, to provide the visible indication that it is time to replenish the fuel supply.

The embodiments shown in the Figures allow for placement of the fuel bottle and fuel receiving reservoir in the liquid fuel burner assembly 10 but at a location where it is also protected from the heat of the flame. To further protect the fuel bottle 22 and liquid fuel burner assembly 10 from the open flame in the embodiment of FIGS. 1-9, they are covered by a hollow artificial log 38 made from ceramic fiber with an openable cover such as shown in FIGS. 4 and 5. The embodiment shown has an opening in the top of the log that is covered by a hinged door 40. A log 39 with a similar outward appearance also sits adjacent and behind the top of the burner. When the door 40 is closed the log 38 looks like a conventional log in front of the fire. When a fuel bottle 22 needs to be placed in the burner assembly 10 the door 40 is opened by swinging upward or rearward so that it also creates a protective barrier from the flames. The used, substantially empty bottle 22 is removed and the new bottle 22 is inserted in its place and pushed down so that the piercing implement 28 punctures the sealed access port 26, thus allowing fuel to flow into and replenish the reservoirs 12, 14.

Figure 10:
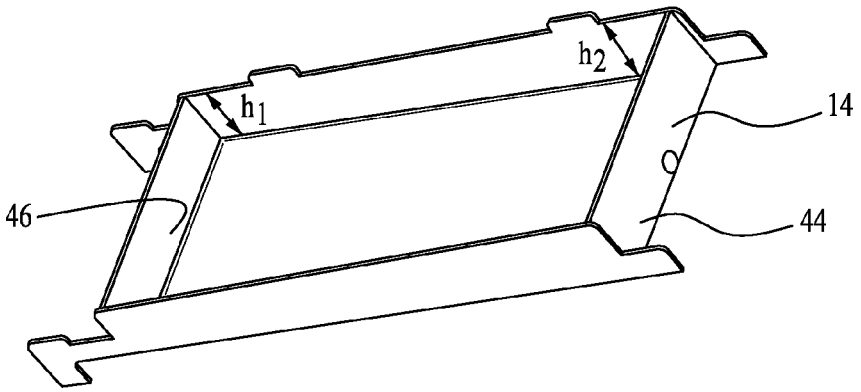
FIG. 10 is a front schematic perspective view of the burner.

FIG. 10 illustrates a further optional feature of the liquid fuel burner assembly 10 wherein the burner 14 has a sloped bottom 42 such that when the fuel is almost totally consumed the remaining fuel resides in the lowest end 44 of the tray, said lowest end constituting a fuel well. As a result the flame, which emanates from the vapor over the remaining fuel in the well, is concentrated at the lowest end 44 of the tray 42, there being no fuel at the opposite, higher end 46. An observer of the flame is then alerted by the flame burning at only one end of the burner 14 above the fuel well that almost all of the fuel 24 has been consumed and it is time to replace the empty fuel bottle 22 with a full bottle, thus replenishing the fuel supply in the burner 14.

While embodiment disclosed herein describes a device and method for providing a continuously burning flame in a fireplace enclosure, including artificial logs, one skilled in the art will recognize that the assembly of various components and their method of use is not restricted to placement within an enclosure and can be readily adapted to use in fire pits and decorative flame display arrangements both indoors and outdoors. In addition, the use of logs is not necessary and could be replaced by many items like rocks, glass, coal beds, etc. For example, FIGS. 11 and 12 illustrate alternative embodiments including multiple burners.

Figure 23:
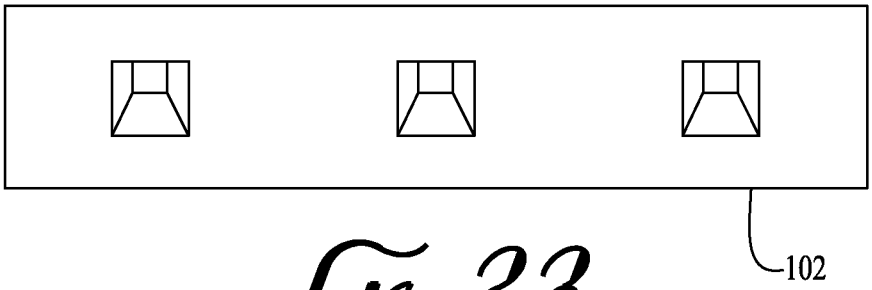
FIG. 23 is a top view of the porous element of FIG. 22.
Figure 24:
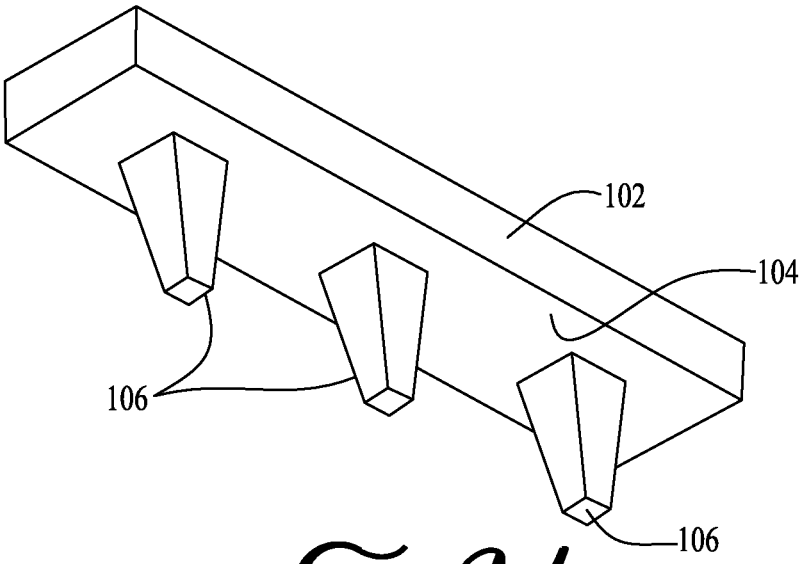
FIG. 24 is a bottom perspective view of the porous element of FIGS. 22 and 23.
Figure 25:
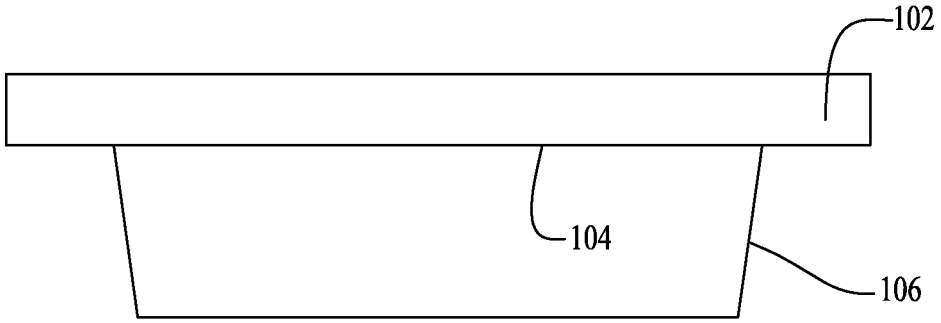
FIG. 25 is a side view of second embodiment of a porous element for placement on the artificial log of FIGS. 16-21.
Figure 26:
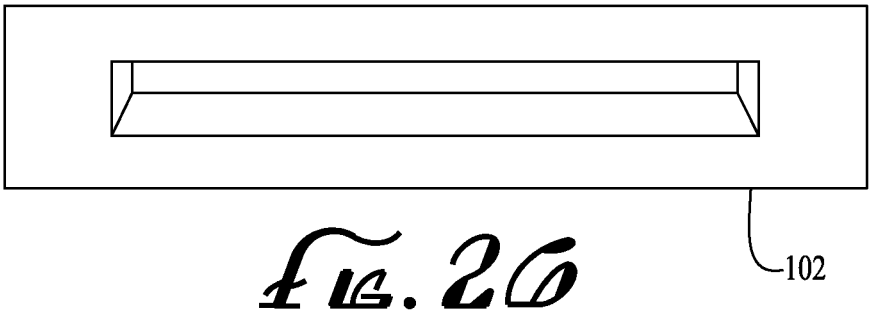
FIG. 26 is a top view of the porous element of FIG. 25.
Figure 27:
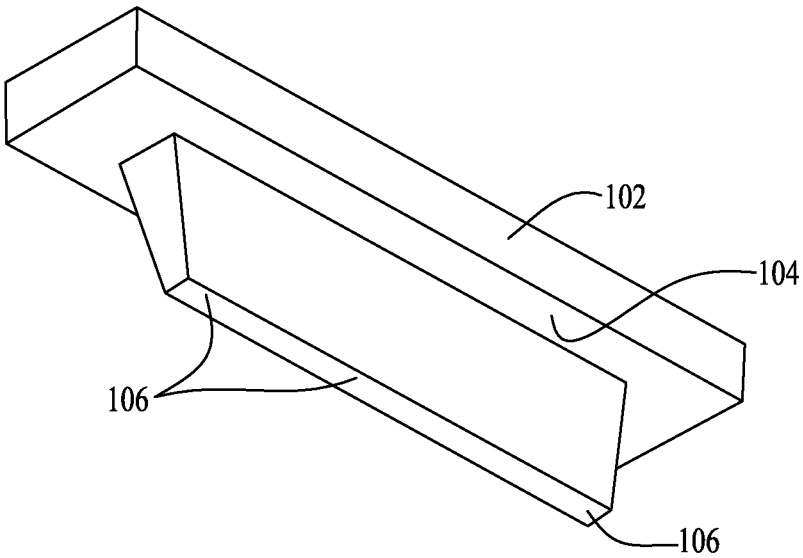
FIG. 27 is a bottom perspective view of the porous element of FIG. 25.

FIGS. 16-25 show various additional alternative embodiments incorporating features of the invention. Generally speaking, a hollow artificial log 100, for example constructed of a heat resistant ceramic material that has the appearance of a natural log, has a burner tray 30 located within the hollow space. Alternatively, a solid log that has a burner tray below it adjacent to the log or partially enclosed therein can be provided. Fuel is fed to the burner tray 30 from a remotely located fuel bottle 22. The artificial log 100 has a porous element 102, which can be removable or permanently attached to the artificial log 100. The porous element 102 can be located on the top of the artificial log 100 or it can be on the side or on a lower surfaces of the log or structure that it is a part of. Suspended from the lower surface 104 of the porous element 102 are fuel conduits 106, also referred to as extensions. These extensions could be integral with the porous element or separate parts that are attached to the porous element and can comprise a single extension as shown in FIGS. 25-27 or two or more extensions. These one or more extensions 106 can be fabricated of a porous wicking material or comprise very small diameter tubes that carry the liquid fuel, or vapors from that fuel, to the outer surface of the porous element 102. The extensions can be varied in length (i.e., short or long) depending on the requirements of the design. In use, lower ends of these conduits are positioned in the liquid fuel in the burner tray 30 so that they can provide the fuel to the upper surface of the porous element 102 by capillary or wicking action. The fuel at the surface of the artificial log is then ignited to provide the appearance of a burning natural log. Alternatively, the surface and sides, as well as the bottom surface of the artificial log 100 can have holes 108 therein (to allow for faster start or larger flames if needed) and/or be porous to allow the fuel in the tray to evaporate and permeate the log 100 faster. Alternatively, the artificial log 100 can be fabricated of porous material or a non-flammable fiber material so that the liquid or vaporized fuel can penetrate the log and then give the appearance that the entire log is on fire. Alternative designs can use the porous log concept and conventional means of pouring the fuel into a fuel reservoir or into the burner tray directly can be used. In addition the log can be replaced by material that may have an aesthetically pleasing effect when it has flames emanating from its surface or surfaces.

Figure 17:
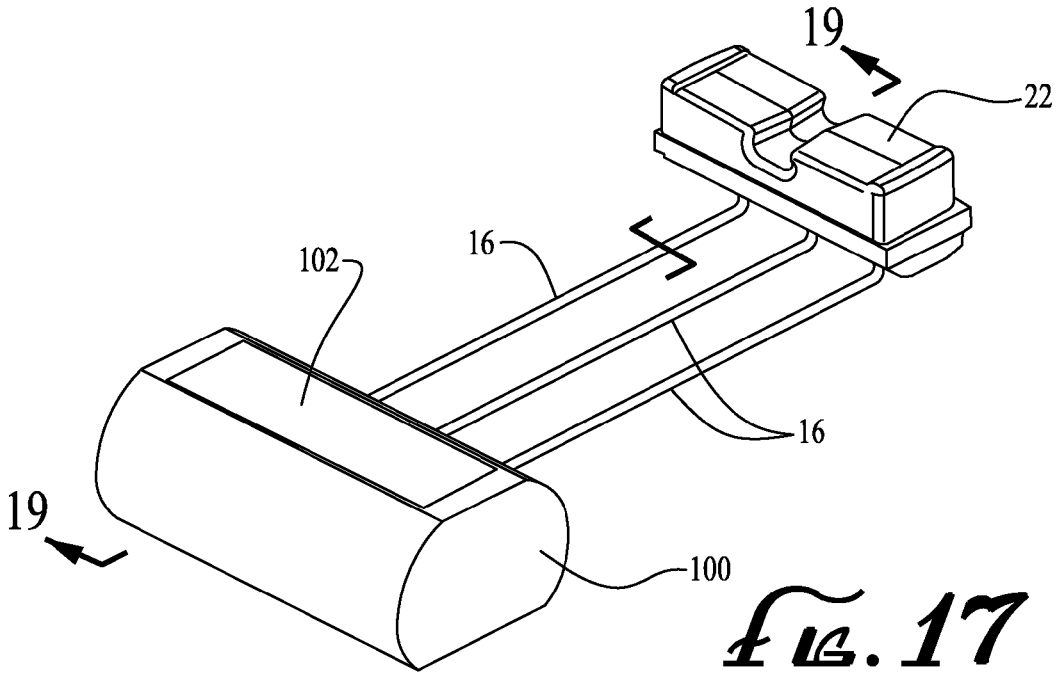
FIG. 17 is a schematic representation of an assembly comprising the artificial log of FIG. 16 connected to a fuel supply reservoir.
Figure 18:
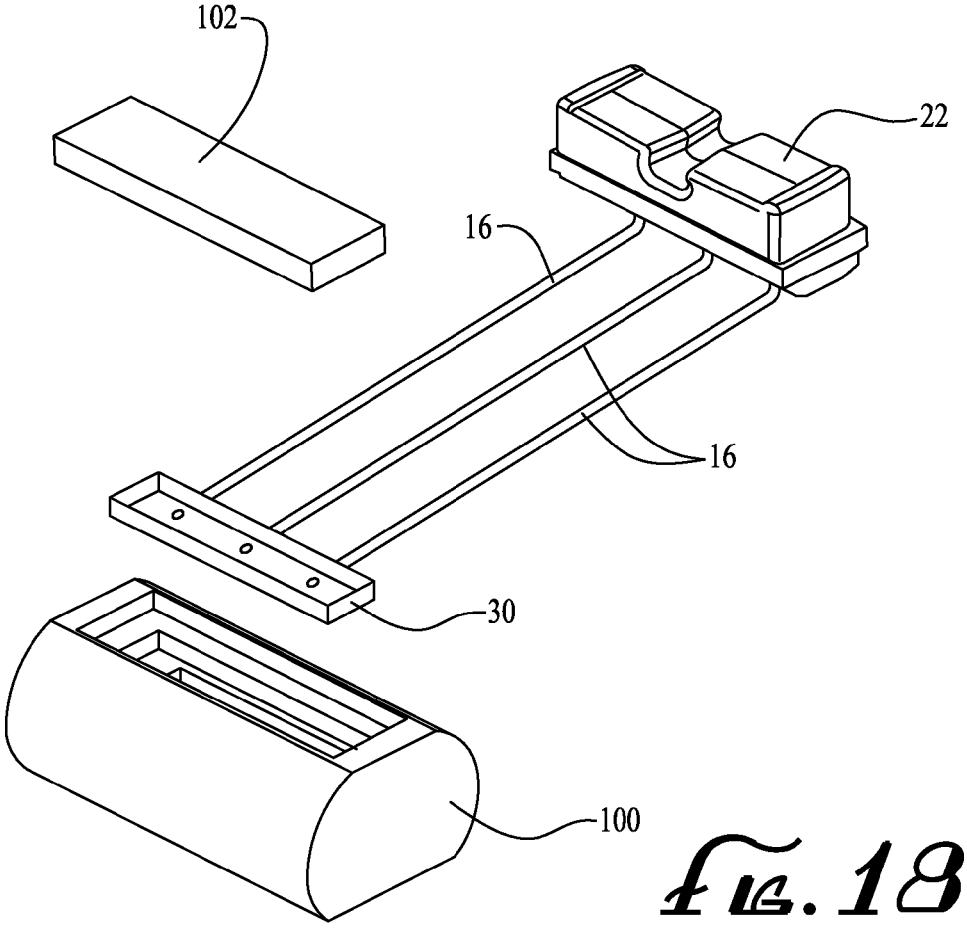
FIG. 18 is an expanded schematic view of the assembly of FIG. 17.
Figure 19:
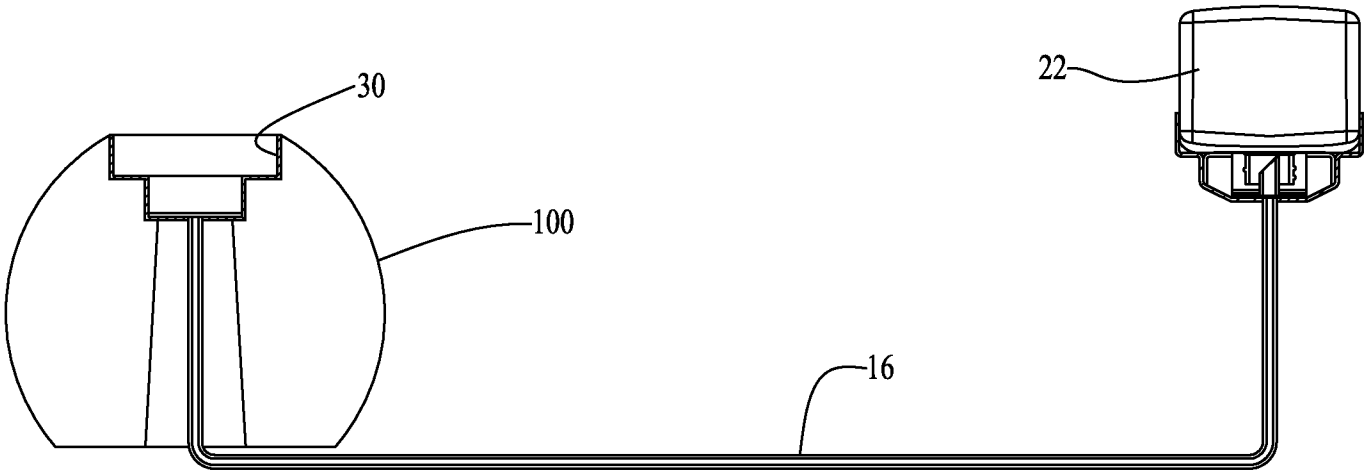
FIG. 19 is a cross sectional view taken along line 19-19 of FIG. 17.
Figure 20:
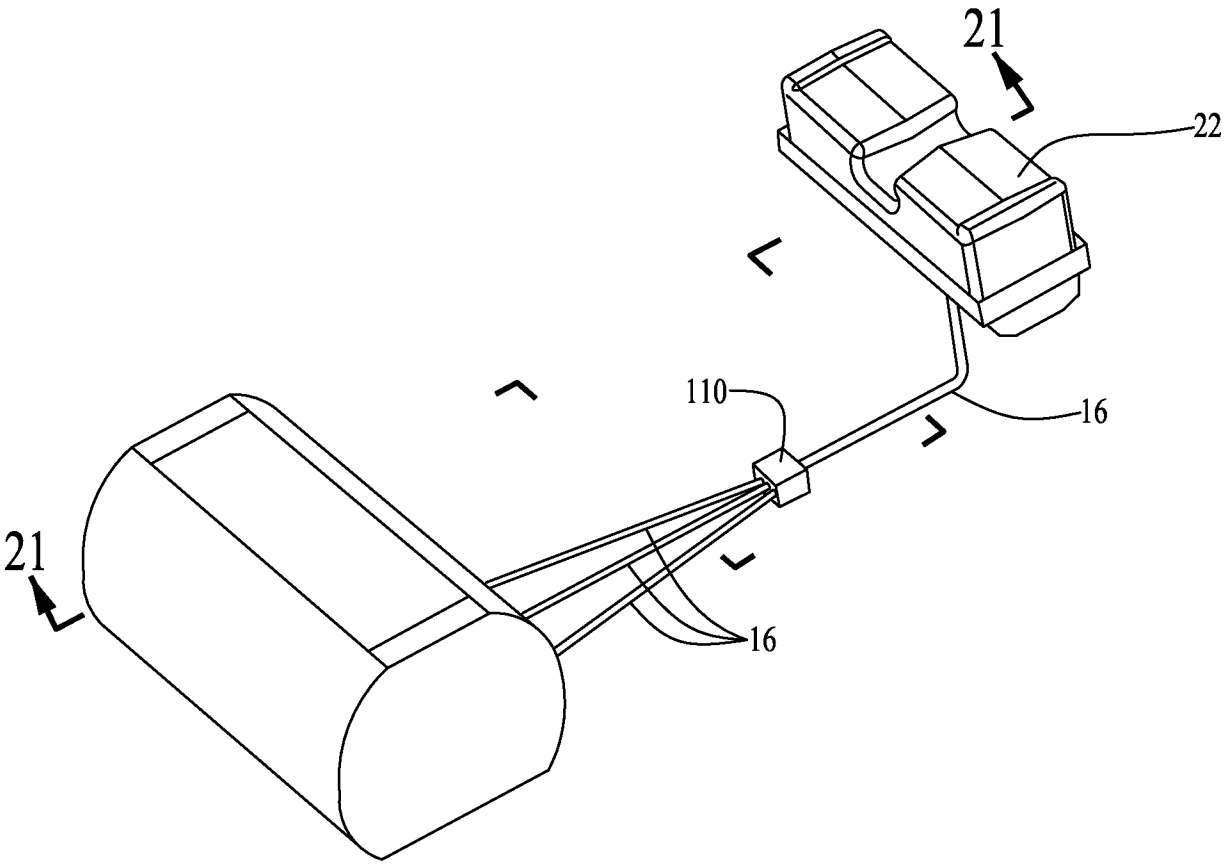
FIG. 20 is an alternative embodiment of the assembly of FIG. 17.
Figure 21:
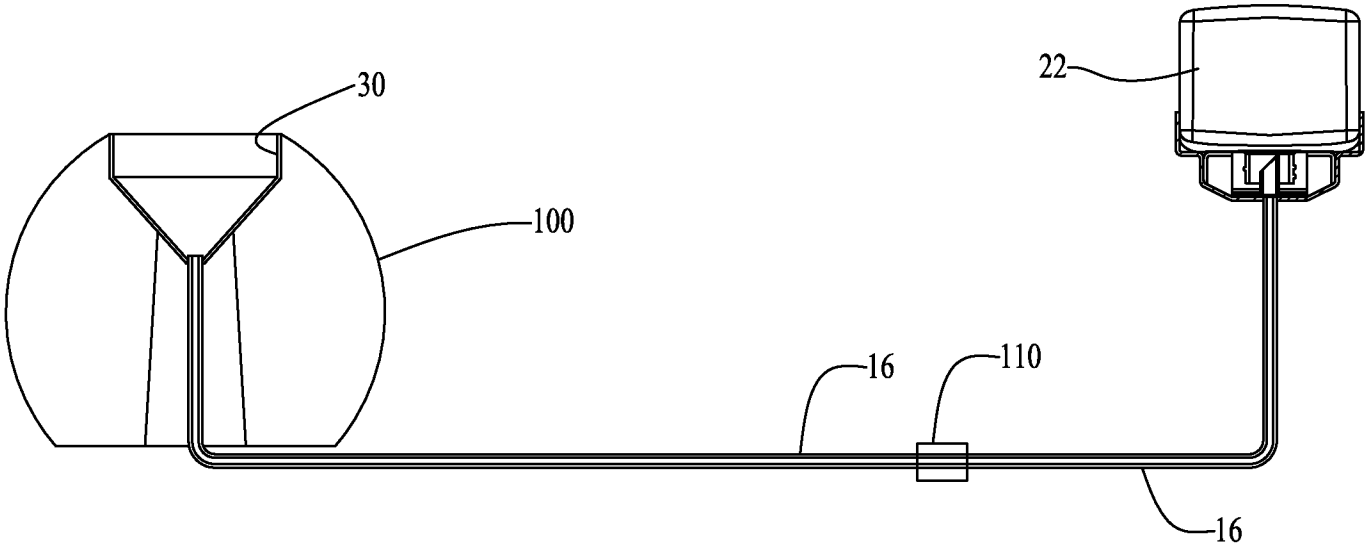
FIG. 21 is a cross sectional view taken along line 21-21 of FIG. 20.

FIG. 17, the expanded view of FIG. 18 and the cross sectional side view of FIG. 19, show a bottle 22 containing a flammable liquid (a fuel) with three conduits 16 for transmitting the flammable liquid between the bottle and the burner tray 30. FIGS. 20 and 21 show a variation with a single conduit 16 connected to the bottle 22. Fluid in the single conduit 16 enters a flow splitter 110 which distributes the fluid into several conduits 16 for feeding the burner tray. While three conduits 16 are shown exiting the splitter 110, any number of conduits 16 can be used to feed the burner tray 30. It should be noted that FIGS. 18 and 19 show a flat bottomed burner tray 30 while FIG. 21 shows a burner tray with a V-shaped bottom. The shape of the bottom of the tray 30 is not critical but the V-shaped bottom of FIG. 21 provides the ability to deliver a greater quantity of fuel. Referring to various figures showing the bottle receiving tray/reservoir in fluid communication with the burner tray, the height of the liquid in the burner tray can be adjusted by moving the bottle tray/reservoir vertically.

Figure 22:
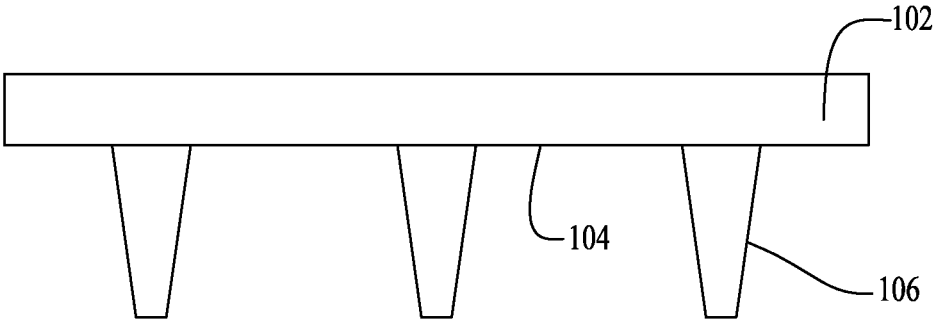
FIG. 22 is a side view of a porous element for placement on the artificial log of FIGS. 16-21.

FIGS. 22-24 show three views of a removable porous element 102 with the extensions 106 extending downward therefrom. They can have an open center portion, as best shown in FIG. 23, of an appropriate cross sectional dimension so as to deliver the fuel from the tray 30 to the upper surface of the porous element 102. As an alternative the extensions can instead be tubes, or enclose tubes, such as micro-tubes. As a further alternative the extensions may include a fibrous or porous material in the open center portion or can be constructed entirely of such a fibrous or porous material. The extensions can also partially fill the burner tray or fully fill the burner tray. Alternatively the porous element 102 can be inserted directly into the burner tray 30 and the bottom surface of the porous element 102 then perform the function of the extensions and allow the fuel to wick up to the surface of the porous element 102 where it is ignited.

FIGS. 25-27 show three views of a porous element 102 with a single extension 106 extending downward. The materials for forming the extension 106 are the same as set forth above for the extensions of FIGS. 22-24. FIGS. 19 and 21 show two examples of burners 30 and FIGS. 22-27 show two alternative designs for the porous element 102, which can be fixed or removable, and extensions 106. Based on the teachings here in one skilled in the art can provide various different configurations that serve the same purpose as set forth herein.

Figure 28:
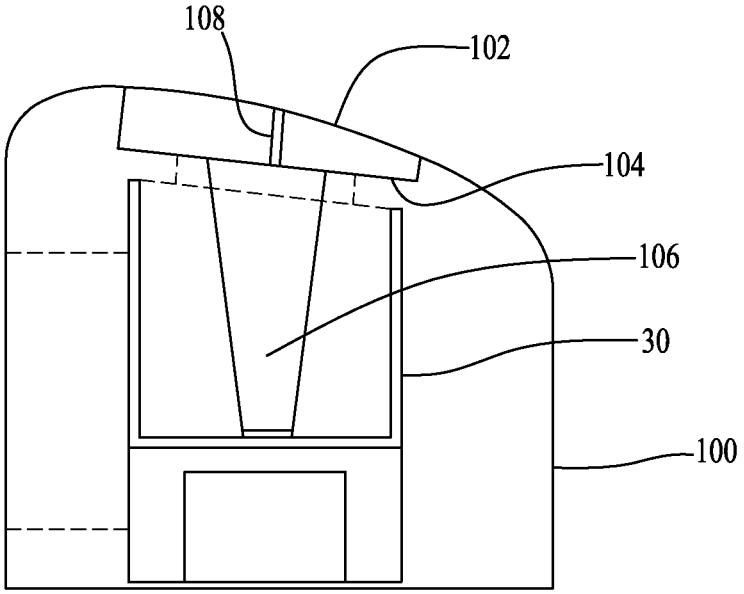
FIG. 28 is an enlarged cross-sectional view of the artificial log and fuel burner taken along line 28-28 of FIG. 16 and incorporating the porous element as shown in FIGS. 22-27.

FIG. 28 is a cross sectional view showing the porous element 102 placed on or in the artificial log 100 with the extensions 106 extending down into a flat bottomed burner tray 30.

Based on the teachings herein multiple alternative arrangements can be assembled to receive one or more bottles of liquid fuel in one or more locations, and then distribute that liquid fuel to one or more burners located between or adjacent to artificial logs or burner trays located within a non-flammable artificial log, in a manner that provides for replacing the fuel source while the flame is burning on the log surface or in one or more burners located between the logs without a need to first extinguish the flame or causing a fire hazard from fuel vapors during the refilling procedure. Alternatively, the logs could be replaced with various different shaped materials that can be used in these devices such as, but not limited to, coal beds, bricks, glass pieces, or any other aesthetically desirable objects. Alternatively, fuel can be poured directly into the burner space adjacent the extensions or into the fuel reservoir and then the fuel is transported to the burner space, for example, by the fuel wicking up the extensions to the outer surface of the log where the fuel can be ignited and burned.

We claim:

1. An improved assembly for creating a fire display from a liquid fuel comprising:

a) one or more fuel receiving reservoirs connected to one or more burner trays by one or more conduits, the conduits providing flow channels from said one or more reservoirs to said one or more burner trays for a liquid fuel placed in said reservoirs, b) a bottle receiving area configured to receive a container of a liquid fuel, and c) the bottle receiving area positioned to provide for delivery of the liquid fuel in the container to the fuel receiving reservoir upon placement of the container in or on the bottle receiving area while the flame display is present, said placement not releasing ignitable fuel fumes, wherein the improvement comprises locating the one or more burner trays within or adjacent one or more non-flammable structures, the one or more non-flammable structures having a porous element, said porous element being in communication with liquid fuel in the burner tray such that the liquid fuel or vapors from the liquid fuel are transmitted to a porous outer surface of the porous element.

2. The assembly of claim 1 wherein the non-flammable structure comprises one or more noncombustible logs with the burner trays adjacent to, enclosed or partially enclosed therein.

3. The assembly of claim 1 wherein the liquid fuel comprises an ester oil, plant oil, alcohol, paraffinic compositions or petroleum product.

4. The assembly of claim 1 wherein the liquid fuel is an alcohol solution.

5. The assembly of claim 1 wherein the liquid fuel is denatured ethanol.

6. The assembly of claim 1 wherein non-flammable structures are composed of a non-flammable porous or fibrous material, the porous or fibrous material suitable for transmitting vapors from the fuel in the burner tray, to portions of the outer surface of the non-flammable structures.

7. The assembly of claim 1 where a fluid level inside the burner is adjustable up and down by adjusting the height of the reservoir containing the fuel by moving the reservoir vertically.

8. The assembly of claim 1 further including at least one extension integral with or attached to a bottom surface of the porous element such that said at least one extension transmits the fuel from the burner tray to the outer surface of the porous element.

9. The assembly of claim 8 wherein the non-flammable structure comprises one or more noncombustible logs with the burner trays adjacent to, enclosed or partially enclosed therein.

10. The assembly of claim 8 wherein the extensions comprise or include a porous or fibrous wicking material or a tubular structure suitable for transmitting fuel in the burner tray, or vapors from the fuel in the burner tray, to the outer surface of the porous element.

11. The assembly of claim 8 where the fluid level inside the burner is adjustable up and down by adjusting the fuel in the reservoir by moving the reservoir vertically.

12. The assembly of claim 8 wherein the non-flammable structures are composed of a non-flammable porous or fibrous material, the porous or fibrous material suitable for transmitting vapors from the fuel in the burner tray, to portions of the outer surface of the non-flammable structures.

* * * * *